US007520218B2

(12) United States Patent
Tebbe

(10) Patent No.: US 7,520,218 B2
(45) Date of Patent: Apr. 21, 2009

(54) GOLF BALL INITIALING DEVICE

(76) Inventor: David L. Tebbe, 12 Forest Hills, Washington, MO (US) 63090

( * ) Notice: Subject to any disclaimer, the term of this patent is extended or adjusted under 35 U.S.C. 154(b) by 0 days.

(21) Appl. No.: 11/129,595

(22) Filed: May 13, 2005

(65) Prior Publication Data

US 2005/0255940 A1 Nov. 17, 2005

Related U.S. Application Data

(60) Provisional application No. 60/571,483, filed on May 14, 2004.

(51) Int. Cl.
*B05C 17/08* (2006.01)

(52) U.S. Cl. ..... 101/128; 101/35; 101/127; 101/DIG. 40; 473/406

(58) Field of Classification Search ..... None
See application file for complete search history.

(56) References Cited

U.S. PATENT DOCUMENTS

| | | | | |
|---|---|---|---|---|
| 1,537,685 | A * | 5/1925 | Ladd | 101/4 |
| 1,537,861 | A | 5/1925 | Moffett | |
| 2,005,787 | A * | 6/1935 | Humphrey | 101/114 |
| 3,584,385 | A * | 6/1971 | Booth | 33/564 |
| 4,086,851 | A | 5/1978 | Brandell | |
| 4,803,922 | A | 2/1989 | Dennesen | |
| 4,852,483 | A * | 8/1989 | Bussard | 101/128 |
| 4,916,826 | A * | 4/1990 | McKeown | 33/564 |
| 5,878,659 | A | 3/1999 | Hatter | |
| 6,004,223 | A | 12/1999 | Newcomb | |
| 6,142,071 | A * | 11/2000 | Fexer | 101/128 |
| 6,209,452 | B1 | 4/2001 | Klimek | |
| 6,216,587 | B1 | 4/2001 | Foley | |
| 6,453,807 | B1 | 9/2002 | Ramey | |
| 6,595,128 | B2 | 7/2003 | Parks | |
| 2001/0052721 | A1 | 12/2001 | Tyke | |
| 2002/0086741 | A1 | 7/2002 | Newcomb | |
| 2002/0139256 | A1 | 10/2002 | Ramey | |
| 2002/0189468 | A1 | 12/2002 | Sosin | |
| 2003/0022724 | A1 | 1/2003 | Rennecamp | |
| 2003/0109319 | A1 | 6/2003 | Andresen | |
| 2003/0153396 | A1 | 8/2003 | Andresen | |
| 2003/0181253 | A1 | 9/2003 | Kim | |

FOREIGN PATENT DOCUMENTS

| | | | |
|---|---|---|---|
| JP | 05286114 | A * | 11/1993 |

* cited by examiner

*Primary Examiner*—Jill E. Culler
(74) *Attorney, Agent, or Firm*—Paul M. Denk

(57) ABSTRACT

A golf or other ball initialing device including a molded ball holder, that incorporates an arcuate slot into which one or more initialing or numbering stencils may be applied, and when pressure fitted upon the ball, allows for the application of a marking pen to trace and imprint letters or numbers onto the surface of the ball, as desired. In addition, a stencil cap may be applied, of the same construction as that as previously defined, but held in position by means of a fastening strap, about the ball, as initialing is performed.

8 Claims, 4 Drawing Sheets

GOLF BALL INITIALING DEVICE

CROSS REFERENCE TO RELATED APPLICATION

This nonprovisional patent application claims priority to the provisional patent application having Ser. No. 60/571,483, which was filed on May 14, 2004.

BACKGROUND OF THE INVENTION

This invention relates generally to means for providing ones initials onto the surface of a golf ball, through the convenient usage of the arcuate stencil or initialing device, which can be easily applied by the ball owner, through the application of an ink, or other demarcating fluid.

The concept of this invention is to provide and facilitate ones application of his/her initials directly to the surface of the golf ball, primarily for identification of the ball, and to prevent its being lost, while participating with in sport of golf.

A variety of marking devices are available in the art, and for use for marking upon the surface of a golf ball, with some indication, primarily for use for lining up a putt, as while participating in the game of golf. For example the published application to Tyke, No. U.S. 2001/0053721A1, shows a golf ball marking guide. This device is just that, a hinged guide formed of opposing top and bottom portions, and having a slot provided therein through which a stenciled line may be applied, for use for lining up a putt, during golf.

The published application of Newcomb, No. U.S. 2002/0086741, shows a device for marking a ball with a cross pattern. The cross pattern is apparently also designed for use as an alignment aid for the golfers during putting, or when undertaking any other stroke.

Another published application to Ramey, No. U.S. 2002/0139256A1, shows a golf ball marking tool. This is similar to what is shown in the Ramey U.S. Pat. No. 6,453,807.

The published application to Sosin, No. U.S. 2002/0189468A1, is upon a method and device for marking of a golf ball. This device can be used for the application of initials, as can be seen, but appears to be of a different structured device, including a breaking mechanism, which is not essential to applicant's design.

A further published application No. U.S. 2003/0022724A1, to Rennecamp, shows a golf ball marking guide. While this device may cradle the ball, it is for use for application of lines, as can be noted, and is apparently not for use for initialing a ball.

The published application to Andresen, No U.S. 2003/0109319A1, is another golf ball marker and method therefore. This device is a form of semi-spherical cover that is applied to the ball, and allows for the application of a series of marks through its slot, as can noted. This device provides for the application of a linear slit, apparently for application of a marker, for forming that alignment line, to enhance the putting of the ball.

Another published application to Andresen, No. U.S. 2003/0153396A1, shows a golf ball marker and method therefore. Once again, this device is for application of a line to the ball apparently for alignment purposes, while undertaking a stroke during participation in the game of golf.

The published application to Kim, No. U.S. 2003/0181253A1, is another golf ball having direction/sighting indications thereon, and the mold for manufacturing and processing of the same.

The U.S. Pat. No. 1,537,861, to Moffett, shows what is identified as a golf ball marker. This is a marker that is provided for marking a golf ball with the owner's name. But, it uses a type of stenciling device, which is rolled over the ball, so that a form of plate, which holds lettering in place, can be applied to the ball and imprint the same with a name, during usage.

The patent to Brandell, U.S. Pat. No. 4,086,851, shows another golf ball marker. This is a form of spring biased ram which can have a type piece, applied to its front edge, and which can imprint a design or lettering upon a golf ball, as noted.

The patent to Dennesen, U.S. Pat. No. 4,832,922, shows a transfer printing apparatus. This is also for use for the application of initials, to a golf ball, as can be seen. But, it requires a much more complex structure, to achieve its imprinting of a name or initials onto the shown ball.

The patent to Hatter, U.S. Pat. No. 5,878,659, shows a type of body member, having a series of initial apertures therein, in the form of letters, numbers, or the like, and which can be wrapped around the ball, and held in position by means of the tongue and slot holder, as shown, for the application of initials or numbers, to the surface of a ball.

The patent prior patent to Newcomb, U.S. Pat. No. 6,004,223, shows another golf ball stencil. This particular device is a type of masking device, or stencil that is apparently used for providing alignment, through marking, to aid the golfer in achieving a better stroke.

The patent to Klimek, U.S. Pat. No. 6,209,452, is another golf ball marking template. This is a type of U-shaped or V-shaped device, as applied to the ball, so as to allow the ball to be marked around its perimeter, as can be noted in the drawings for this patent.

The patent to Foley, U.S. Pat. No. 6,216,587, shows another golf ball marking device. This may comprise a form of resiliently and deformable body, having a retention cavity, which frictionally secures to the golf ball, so that apparently a marker may be applied to the various slots, for presenting an alignment line, as can be noted. This is for providing guidance during the stroking of the ball, either when putting, or when driving of the same.

The patent to Ramey, U.S. Pat. No. 6,453,807, and as previously reviewed with respect to a publication, shows a golf ball marking tool.

Finally, the patent to Parks, U.S. Pat. No. 6,595,128, shows another golf ball stencil.

The subject matter of this current invention is designed to provide for the personalized initialing of golf balls, and note necessarily for use for alignment purposes.

SUMMARY OF THE INVENTION

This invention relates to means for personalizing ones golf ball with ones initials. While the device is shown as designed for application to a golf ball, it is just as likely that a similar type of stenciling could be made much larger, for use for application to a tennis ball, softball, baseball, or any other ball.

Essentially, the device includes a molded ball holder, one which includes an arcuate slot therein, and into which a stencil holder and various stenciling initials may be applied, before the ball holder is fitted, by pressure, to the ball, and to hold the same into position thereon. Once the ball is snapped in place, the ball holder retains the initialing therein, and one may simply ink their initials onto the ball, through the alphabet initials, and leaving a permanent outline of the initials, thus allowing for personal identification of the ball during usage, or thereafter.

The molded ball holder includes a rather arcuate shaped member, usually, in the preferred embodiment, one which is slightly resilient, and which has its outer edges slightly less than the dimensions of the ball, or incorporates ribs therein at that location, so this ball holder can be snapped in place upon the ball, and held in that position, during usage. The holder includes an arcuate slot therein, with letter mounting means, with the letters being formed in the shape of individual stencils that can be applied to the mounting means, and held in position, slightly displaced from the surface of the ball, to allow the ball holder to be snapped into place, compressed about the ball, in preparation for initialing. Then, one may simply use a marking pen to trace the openings for the initials and ink directly onto the surface of the ball, perfect lettering, of uniform size and dimensions, as initials of the ball owner, in preparation for usage. The ball holder may be removed, through the exertion of a slight amount of pressure, the ink is then allows to dry, furnishing a ball with ones initials which thereby personalizes the ball, to the benefit and pleasure of the owner. Furthermore, under such initialized conditions, when the ball is used, the player may easily find his/her ball, out on the fairway, or in a rough, and immediately know that the ball is theirs, because of the presence of ones personalized initials.

The molded ball holder may include select appendages, which can provide for the fast held gripping of the holder, during its installation, or for removal, as may be desired. In addition, the initialed stencils may have spacer means provided thereon, so as to assure that the lettering stencils are displaced from the surface of the ball, and do not allow the ink to be smudged or run, once applied.

A further modification to the subject matter of this invention can be the application of a band type of stencil holding means, which can be held in place, upon a less than semi-spherical surface of the ball, and locked into position by means of a fastening strap, that holds the initialing stencil in place, during application of an ink, but which can be very easily removed, once initialing has been completed.

It is, therefore, the principal object of this invention to allow one to personalize a ball through the application of initials directly to the surface of the golf ball.

Another object of this invention is to provide for means for initialing any type of ball, in preparation for its usage, and to personalize the same through the application of the owner's initials or other marking indicia.

Still another object of this invention is to provide a ball holding device, that may be of an integral mold, and be designed having characteristics that allows for its pressure fitting onto the ball, and retention in position once applied, in preparation for stenciling.

Still another object of this invention is to provide a molded ball holder into which a series of initials may be applied, or replaced, as desired, in preparation for inking of ones initials onto the surface of a golf ball.

Still another object of this invention is to provide for means for numbering a ball, if such may be desired through the usage of the molded ball holding device of this invention.

Yet another object of this invention is to provide for an arcuate cap, into which individual stenciling initials may be applied, held by a fastening band in place, in preparation for the application of the inking of initials, or numbers, onto the surface of any ball.

These and other objects may become more apparent to those skilled in the art upon review of the summary of the invention as provided herein, and upon undertaking a study of the description of its preferred embodiment, in view of the drawings.

DESCRIPTION OF THE PREFERRED EMBODIMENT

Figure 1:
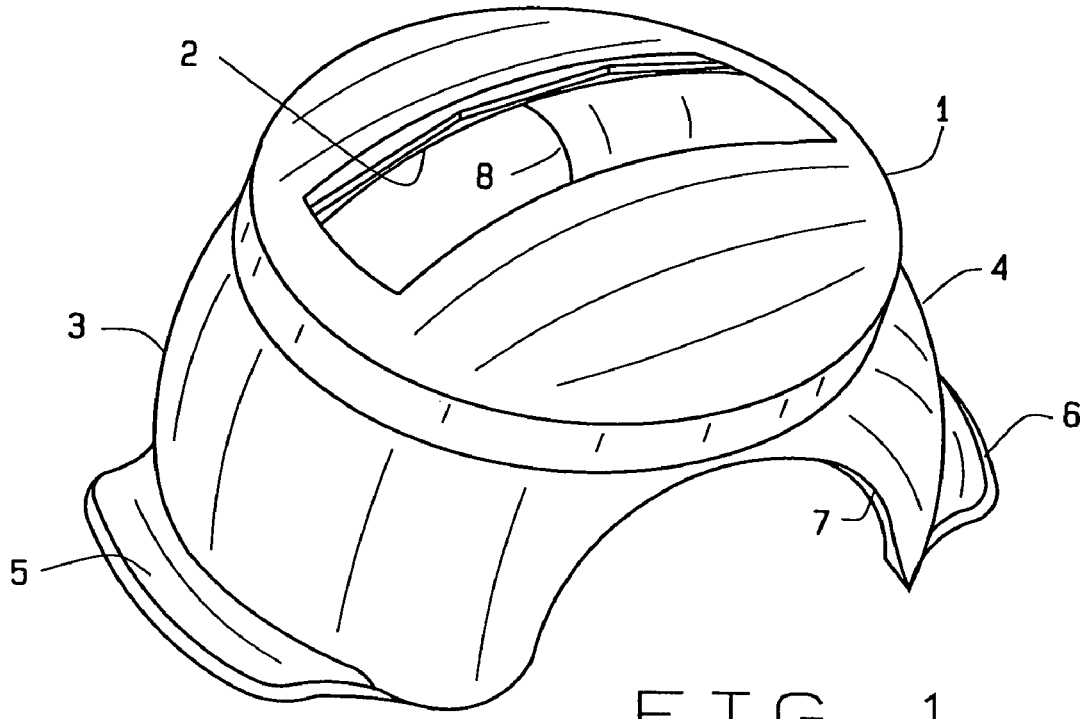
FIG. 1 is an isometric view of the molded ball holder of this invention.

In referring to the drawings, and in particular FIG. 1, the molded ball holder 1 of this invention is readily disclosed. In includes an arcuate slot, as at 2, to which the individual initials or numbers, by way of individual stencils, can be applied, and held, usually by pressure fit, into position in preparation for application of the holder to the ball, when the inking of initials is to be applied to the surface of the embraced ball. The holder includes a further downwardly extending surface, as at 3 and 4, provided to either side of the holder, and is arranged, and has dimensions, approximating the semi-spherical shape of the ball, to which the holder is to be applied. Integrally extending outwardly from the lower edge of the extensions 3 and 4 are flanges, as at 5 and 6, and which will aid one in the application, by pressure, of the holder to the surface of the ball, or to facilitate its removal, through the application of pressure to the flanges when it is desired to lift, with some slight force, the holder off of the ball, after an inking of the stenciled initials has been done to the surface of the ball.

Figure 2:
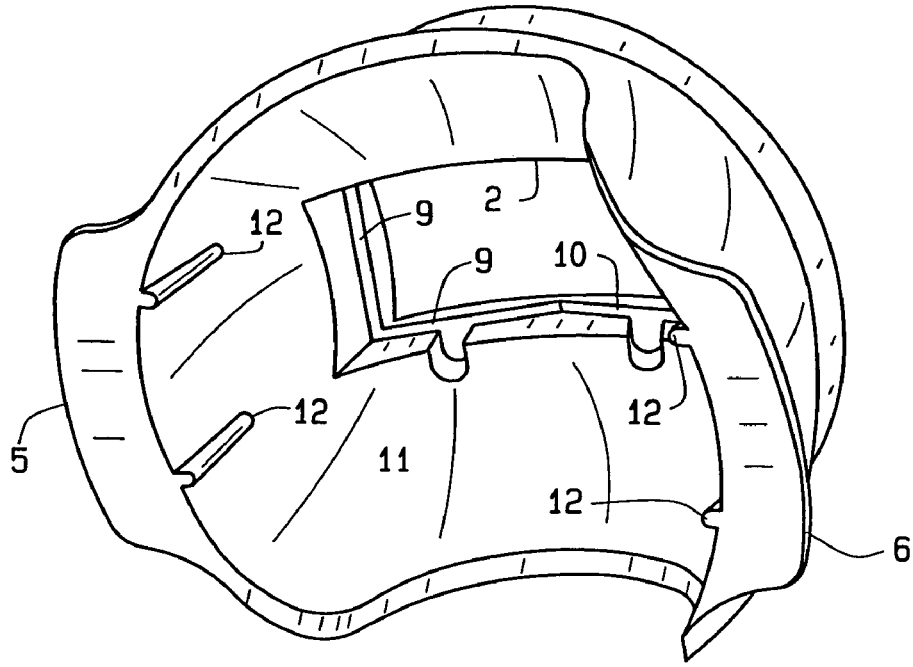
FIG. 2 is an internal view of the molded ball holder as shown in FIG. 1.

As one can see there is clearance provided to either side of the holder, as at 7 and 8, the user can grasp the surface of the golf ball at these locations, when the holder is being lifted off the ball, or when even applied thereto, during its usage. FIG. 2 provides an interior view of the holder as shown in FIG. 1. As can be noted, the arcuate slot 2 includes a recessed shoulder around its perimeter, as at 9, and may even be beveled, as noted at 10, as in this particular instance, there will be a complete shoulder, as at 9 or 10, for holding one of the initialing stencils in place, as they are pressure fitted therein, in preparation for the initialing of a golf or other ball, as during usage of this device. It can also be noted that the interior surface of the holder, as at 11, is generally hemispherical in shape so as to readily accommodate in reasonable contiguity the surface of the ball once the holder is applied. Pressure by way of the holder, onto the surface of the ball, in order to allow for the retention and embracing of the ball in position, once the holder is applied, is obtained by means of the pressure ribs, as shown at 12, which are used for biasing with some degree of force against the surface of the ball, to hold the holder in position, in preparation for stenciling. As previously reviewed, the flanges 5 and 6 are provided to facilitate the application of the holder in place, through the exertion of some degree of pressure, or to accommodate the removal of the holder, once initialing has been performed.

Figure 3:
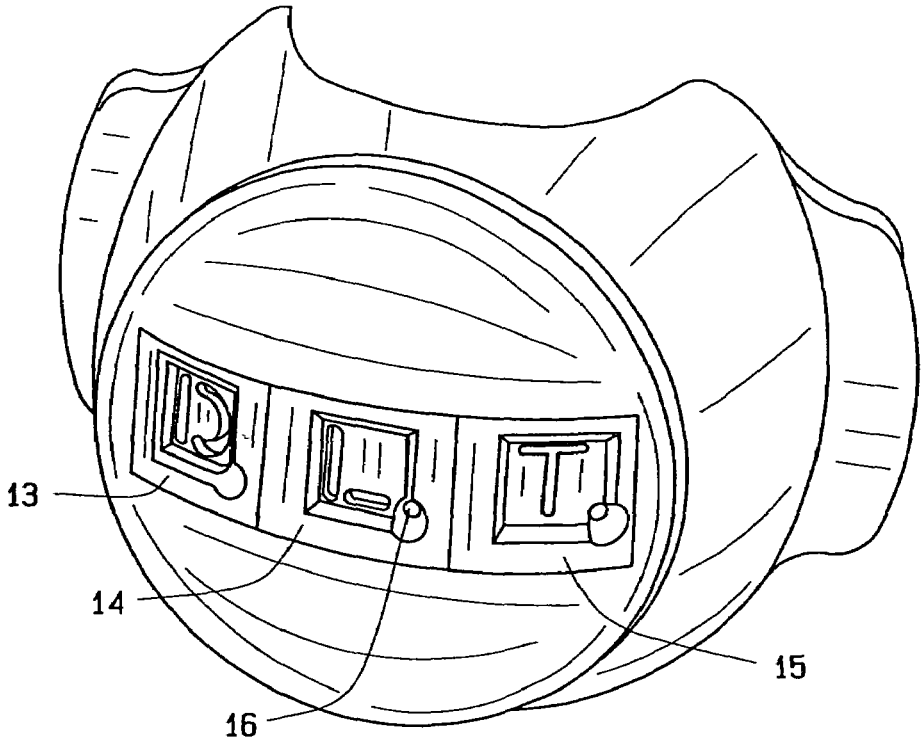
FIG. 3 is an external view of the molded ball holder of FIG. 1, having the stenciling initials applied thereto in preparation for inking.

As can be seen in FIG. 3, in this particular instance, three stenciling initials, as can be noted, representative of the initials D, L, and T, can be seen at 13-15 respectively. In addition, there is even provided the small holes, one as shown at 16, for providing for the application of a period, after each initial, proof of the initialing acronym of one's name to the surface of the ball.

Figure 4:
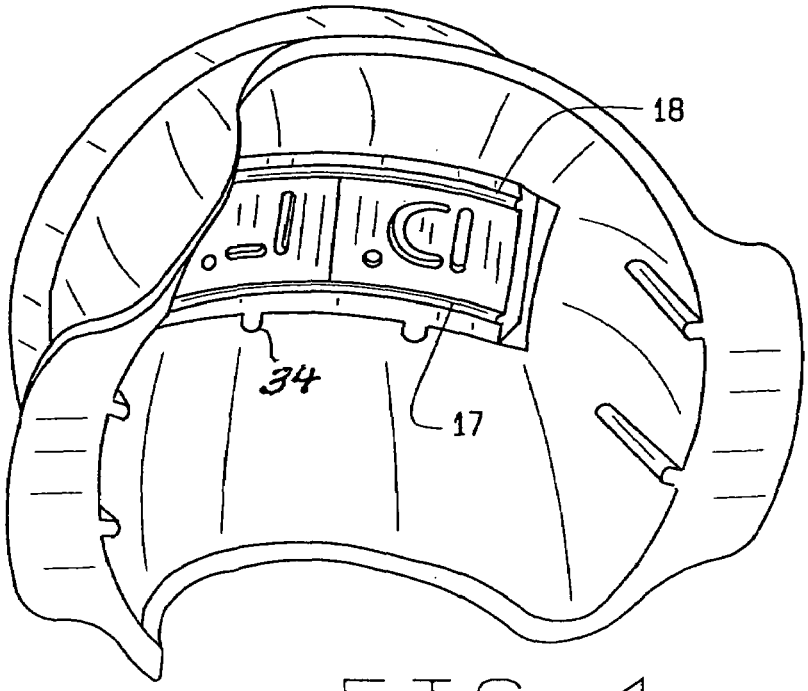
FIG. 4 is an internal view of the molded ball holder, with stencils applied, as shown in FIG. 3.

As can also be noted, as in FIG. 4, each of the initials, as applied, in the way of the stencils 13-15, have uniform ribs, as at 17 and 18, so as to assure that the stenciling initials are held off the surface of the ball, to prevent the smudging of any ink as applied thereto, by means of the marking pen that is applied through the slots of the shown letters, or the period, as can be noted.

Figure 5:
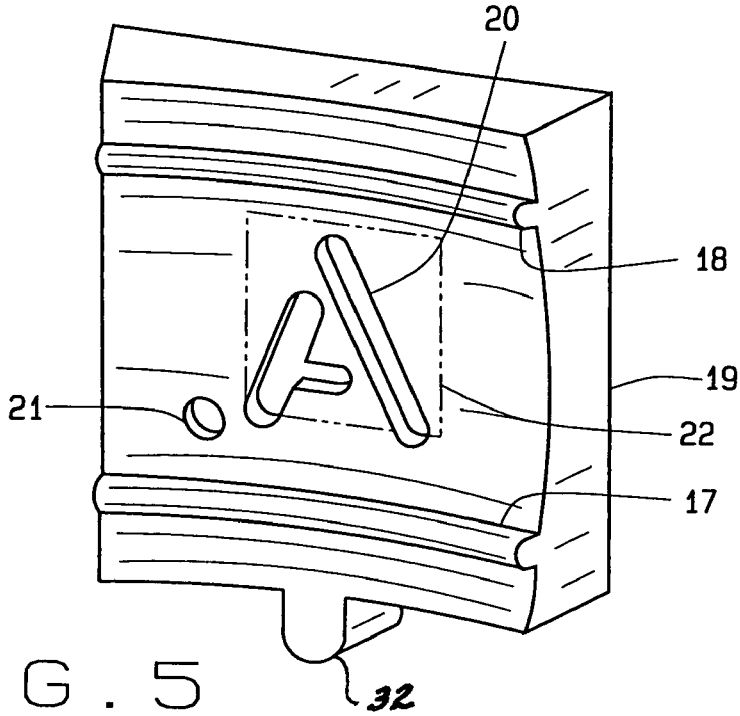
FIG. 5 shows an individual stenciling initial for application to the ball holder.

FIG. 5 shows an individual initial stencil, as at 19, and in this particular instance comprising the letter A, as at 20, and its period aperture, as at 21, can be noted. The ribs 17 and 18, integrally formed upon the interior of the stencil, are provided for furnishing that raised effect, for each letter, to keep its space from the surface of the ball, and to prevent smudging of any ink, as applied thereto, during usage.

As can be further seen in FIG. 5, there is extending integrally from the bottom of each individual stencil a tab or key 32 which fits within a corresponding and compatible slot, as at 33 (see FIG. 4) of the holder, to assure that the stencil is properly aligned, when one or more of them are applied to the holder, in preparation for initialing a ball. These are alignment means, to provide for a more professional look to the finished stenciling.

Figure 6:
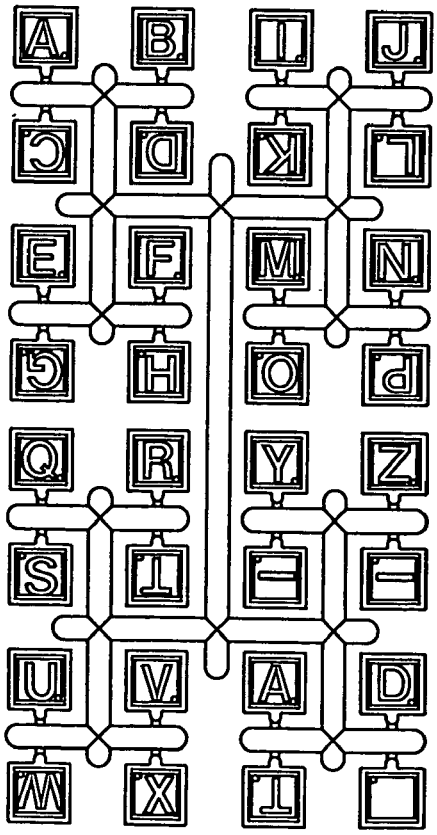
FIG. 6 shows a series of the stencils, with a variety of initials, or even numbers that may be supplied with the molded ball holder of this invention.

FIG. 6 shows how a complete set of initial stencils can be formed, and marketed with this ball holding device, to assure that anyone's initials can be applied, or even numbering, if it is desired to number a ball, in addition to its initialing, for personalization. In addition, the stencil holder 19 may be designed for having each individual letter, of a square configuration, as noted at 22, pressure fitted therein, where it is desired to utilize a singular stencil holder, that extends the length of the acruate aperture 2, for application into the ball holder, in preparation for its usage and application.

Figure 7:
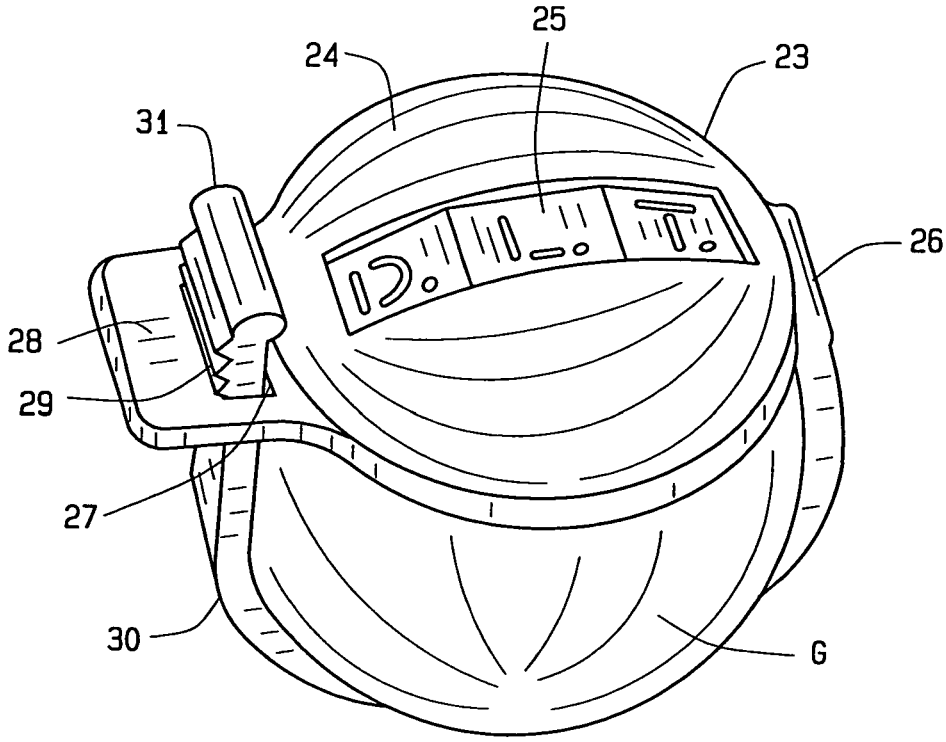
FIG. 7 shows a variation upon the structure of the molded ball holder of this invention, where a stencil holding cap may be held in position, about the shown golf ball, by means of an engaging strap.
Figure 8:
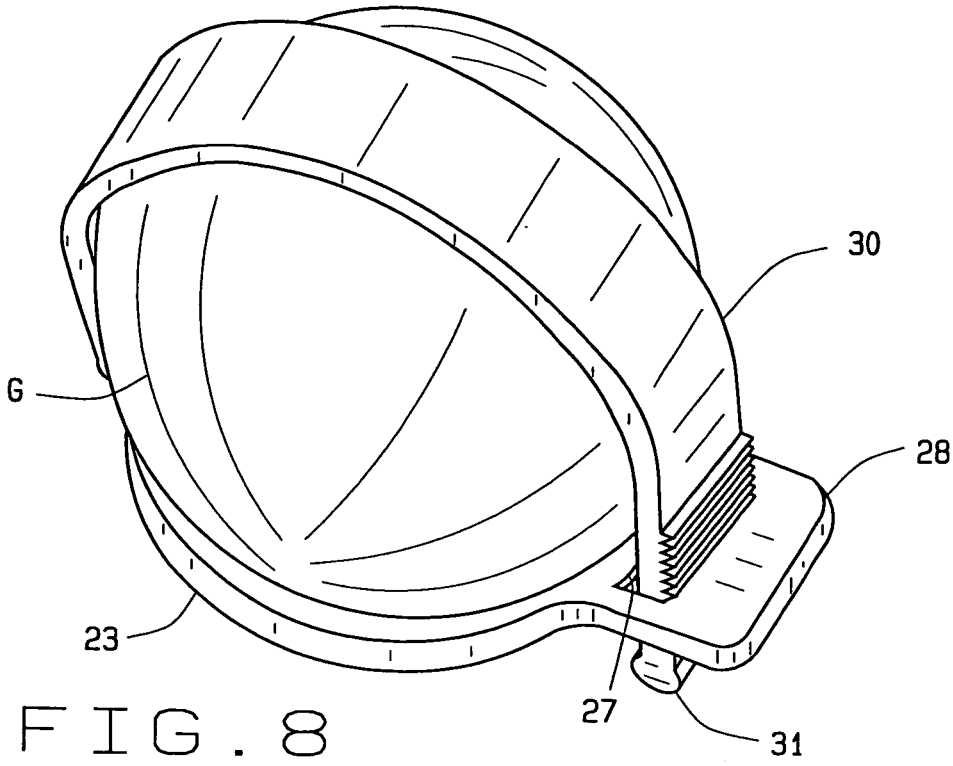
FIG. 8 shows a bottom view of the banded initialing device of FIG. 7.

Modification to the invention is shown in FIGS. 7 and 8. As noted, in this particular instance, the stencil holder is a smaller dimensioned cap, as at 23, includes its arcuate stencil aperture 24 therein, to which the stencil holder can be applied, as at 25, and each stencil holder, in the manner as previously described for the holder 19, may have a series of initials applied therein, as can be noted. Thus, a marking pen can be applied through the slots of the various initials, to furnish the application of an ink, to the surface of the ball, as noted for the golf ball G, embraced by the ball holder of this invention. As can be seen, integral straps extends from one end, as at 26, of the cap 23, and is designed for embracing around the ball G, and for inserting through a slot, as at 27, said slot 27 being formed through the integral flange 28 provided at the left side edge of the ball cap 23. A series of serrations, as at 29, are provided upon the outer surface of the end of the strap 30, and which engage the edge of the slot 27, and are for fastening of the ball marking cap 23 in place, during its usage. The strap may include an enlarged end 31, to facilitate the insertion and application of the strap in place, as the ball marking cap 23 is applied, when readied for initialing of the golf ball, as noted. An underside view of the cap 23, and its integral strap 30, and how its end 31 inserts through the slot 27, can be more conveniently seen herein. In addition, the applied initialing stencil, as at 25, can be readily noted.

As previously reviewed, the concept of this invention is to provide a golf ball initialing device. But, it is just as likely that the concept of this invention could be enlarged, for application to a ball of any size, such as a baseball, softball, or the like or a tennis ball as can be imagined, so one may initialize, or add one or more numbers, to the surface of the ball, for identification purposes. This also allows the owner to personalize any ball, as he/her may desire.

The method for application initials, letters, or numbers, to personalize a ball, may be performed as follows. The molded ball holder, or the stencil cap, may initially have any letters or numbers removed therefrom. One may insert various letters, preferably or desirably in the order of one's initials, into the stencil holder within the ball holding device, and these will be generally applied, by some degree of pressure, or snapped into position, for retention. With the holder, and the letters inserted, upside down with respect to the ball, the ball may be snap applied into the holder, careful not to position the initials of the stencil over any existing ball markings, and the ball will retain the letters in place, and hold the stencils identifying the initials into position. Due to the pressure fit of the stencil holder onto the ball, or through the usage of a band to hold the stencil cap in place, one may then use a marking pen to supply trace letters, such as initials, letters, or numbers, directly onto the surface of the ball, and in the position as desired. If duplicate letters are required, one may simply insert a blank in place of any additional letter, and reposition the ball and holder in place, aligning the blank with the other letters, and then insert the desired letter or number into the stencil holder, in preparation for ink tracing. When completed, the entire ball can be pressure removed form the holder, or the strap holding the stencil cap in place may be opened and removed, providing a ball that has been personalized, to the desire and wishes of the owner.

Variations or modifications to the subject matter of this invention may occur to those skilled in the art upon review of the disclosure as provided herein. Such variations, if within the spirit of this development, are intended to be encompassed with in scope of the invention as described. The description of the preferred embodiment and as shown in the drawings, are primarily set forth for illustrative purposes only.

The invention claimed is:

1. A golf ball initialing device including a molded ball holder, having an interior spherical surface that may be held in position contiguous the surface of the ball, said ball holder having an arcuate slot provided therein, at least one stencil holder for holding of one or more initials, letters, or numbers in place within the arcuate slot, said ball holder being pressure fitted onto the surface of the ball, in preparation for the application of a marking pen to apply one of initials, letters, or numbers to the surface of the ball, said ball initialing device including uniform ribs provided integrally of the holder and spaced above and below the location of each stencil to allow for the stenciling of initials, and to prevent the smudging of any ink when applied to the ball during a stenciling operation.

2. The golf ball initialing device of claim 1 and including holding means extending from the ball holder, and capable of being grasped for applying pressure to the holder during performance of stenciling upon a ball.

3. The golf ball initialing device of claim 1 and wherein each stencil has a hole provided therethrough for use for facilitating further imprinting upon the ball during stenciling.

4. The golf ball initialing device of claim 1 wherein said ball holder has an opening therein through which a golf ball may insert within the initialing device, pressure ribs provided integrally upon the interior surface of the holder, and said ribs extending from its opening and a short distance interiorly of the spherical surface to assure that the holder snugly fits about the ball during a stenciling operation.

5. The golf ball initialing device of claim 1 wherein said stencils, during their formation, are linked together to assure their composite connections before usage.

6. The golf ball initialing device of claim 5 and wherein each stencil having a tab extending from one edge, and the linking of the stencils together is integrally provided through each tab.

7. A golf ball initialing device including a molded ball holder, having an interior spherical surface that may be held in position contiguous the surface of the ball, said ball holder having an arcuate slot provided therein, at least one stencil holder for holding one or more initials, letters, or numbers in place within the arcuate slot, said ball holder being pressure fitted onto the surface of the ball, in preparation for the application of a marking pen to apply one of initials, letters, or numbers to the surface of the ball, each stencil provided with uniform ribs, and spaced above and below its respective initial, letter, or number, to allow for stenciling and to prevent the smudging of any ink when applied to the ball during a stenciling operation.

8. A golf ball initialing device including a molded ball holder, having an interior spherical surface that may be held in position contiguous the surface of the ball, said ball holder having an arcuate slot provided therein, at least one stencil holder for holding of one or more initials, letters, or numbers in place within the arcuate slot, said ball holder being pressure fitted onto the surface of the ball, in preparation for the application of a marking pen to apply one of initials, letters, or numbers to the surface of the ball, said ball initialing device including a strap, connecting at one end with the holder, said strap at its other end having an engagement means, and said strap at its other end engaging with the opposite side of the holder to retain the holder contiguous with the ball during a stenciling operation.

* * * * *